US005896898A

United States Patent [19]

Crossdale et al.

[11] Patent Number: 5,896,898

[45] Date of Patent: * Apr. 27, 1999

[54] DISPENSER

[75] Inventors: Garry William Crossdale, Ripley; Michael James Stevens, Littleover, both of United Kingdom

[73] Assignee: Diversey Lever, Inc., Plymouth, Mich.

[ * ] Notice: This patent is subject to a terminal disclaimer.

[21] Appl. No.: 08/475,754

[22] Filed: Sep. 18, 1995

Related U.S. Application Data

[62] Division of application No. 08/042,802, Apr. 5, 1993, Pat. No. 5,456,297.

[51] Int. Cl.[6] ..... B65B 1/04; B65B 3/04

[52] U.S. Cl. ..... 141/83; 141/165; 141/141; 141/160; 141/352; 141/DIG. 1; 141/360; 220/675; 215/383

[58] Field of Search ..... 141/83, 165, 141, 141/143, 140, 156, 157, 160, 161, 311 R, 346, 347, 351, 352, 354, 357, 359, 368, 369, 372, 377, 271, DIG. 1, 86, 88, 360–362, 378, 367; 220/675, 759, 751; 215/383, 384, 396, 399

[56] References Cited

U.S. PATENT DOCUMENTS

| | | | |
|---|---|---|---|
| 532,235 | 1/1895 | Grap | 141/359 |
| 2,518,349 | 8/1950 | McCabe | 141/354 |
| 2,757,846 | 8/1956 | Varrin | 141/359 |
| 3,335,807 | 8/1967 | Tytus | 141/359 |
| 3,347,325 | 10/1967 | Espenschied et al. | 141/359 |
| 3,580,304 | 5/1971 | Chermack | 141/244 |
| 3,934,626 | 1/1976 | Hall | 141/117 |
| 3,993,218 | 11/1976 | Reichenberger | 222/30 |
| 4,163,464 | 8/1979 | Velling | 141/198 |
| 4,164,964 | 8/1979 | Daniels | 141/329 |
| 4,386,635 | 6/1983 | Ahlers et al. | 141/6 |
| 4,456,040 | 6/1984 | Bacroix et al. | 141/150 |
| 4,791,251 | 12/1988 | Carter et al. | 200/33 |
| 4,811,862 | 3/1989 | Rutty et al. | 222/63 |
| 4,883,199 | 11/1989 | Ouarve et al. | 222/14 |
| 4,907,630 | 3/1990 | Kulikowski et al. | 141/311 R |
| 4,932,445 | 6/1990 | Biehl | 141/83 |
| 4,957,147 | 9/1990 | Lowe | 141/83 |
| 5,102,015 | 4/1992 | Barnard et al. | 222/135 |

FOREIGN PATENT DOCUMENTS

| | | | |
|---|---|---|---|
| 572435 | 3/1959 | Canada | 141/359 |
| 815490 | 7/1937 | France | 141/372 |
| 1364764 | 7/1964 | France | 141/359 |
| 108511 | .6/1975 | France | 141/359 |
| 814259 | 9/1951 | Germany | 141/359 |
| B1041383 | 10/1958 | Germany . | |
| U9107528 | 10/1991 | Germany . | |
| U9112312 | 11/1991 | Germany . | |
| A4021790 | 1/1992 | Germany . | |
| U9113538 | 2/1992 | Germany . | |
| 2193704 | 2/1988 | United Kingdom . | |

*Primary Examiner*—Steven O. Douglas
*Attorney, Agent, or Firm*—A. Kate Huffman

[57] ABSTRACT

A dispenser is described having a support for the container to be filled, a source of liquid and a switch controlling the flow of liquid into the container. The container is supported by a support which urges the container up or down. The switch is operated by the container such that when the container is empty it urges against a resilient mechanism which activates the switch. When the container is filled its weight overcomes the resilient mechanism.

7 Claims, 5 Drawing Sheets

24

37
38
35

DISPENSER

This is a divisional of the application Ser. No. 08/042,802, now U.S. Pat. No. 5,456,297, filed Apr. 5, 1993.

FIELD OF THE INVENTION

The invention relates to a dispenser for dispensing Detergents and other cleaning liquids, for example.

BACKGROUND OF THE INVENTION

In many industrial and semi-industrial situations, for example in large kitchens or in hotels, it is necessary to regularly fill small containers with a cleaning and sanitizing liquid from a constant supply or a bulk container of the liquid. Typically this is done by filling the small container from a manually operated tap. A disadvantage of this system is that care needs to be taken by the user to ensure that the container is filled to the correct level but not so much that the liquid overflows, creating a hazard in the working environment.

It is commonplace for supplies of different liquids to be provided at the same place. Where this happens, there is an obvious risk that the wrong liquid might be filled into the wrong container. Attempts have been made to overcome this problem by color coding the sources of liquid and the containers but this does not entirely eliminate the possibility of human error.

The present invention, in its different aspects, is aimed at overcoming or ameliorating one or both, of the above-described problems.

SUMMARY OF THE INVENTION

Accordingly, the invention provides a dispenser for filling a container with a liquid, comprising: a support for the container to be filled; a source of liquid; switch means controlling the flow of liquid into the container; and resilient means urging the said support in an upwards direction; wherein the switch means is operated by the container on the support, whereby the switch is activated by the empty container being urged upwards by the resilient means and deactivated when the weight of the filled container overcomes the force of the resilient means.

The support can be a platform on top of which the container sits, but it is preferably a cradle which holds the container by its upper portion—for example its neck with the major part of the container depending from the cradle. This latter arrangement has the advantage that different size bottles can be filled from the same dispenser without adjustment, unlike the former arrangement in which the distance between the source of liquid and the platform defines the height of the container to be filled so that the platform position needs to be changed for use with different containers.

It is apparent that because, in the invention defined above, the weight of the filled container controls the supply of liquid, over-filling is not a problem; the liquid is turned off when the container is full so that it can then be removed and an empty container put in its place.

In the embodiment with a cradle from which the container in use depends, the cradle is preferably pivoted about a substantially horizontal axis. This embodiment has the advantage of relative simplicity, with the empty container being mounted by simply pulling down the pivoting cradle, against the action of a spring force, slotting in the container and letting it go. As the container is filled, its weight forces the cradle down again until it is at a position when the source of liquid is turned off. The full container is then removed.

In a preferred embodiment, it is advantageous for the container to slot into the cradle, with parts on the container and the cradle inter-engaging so that the container is suspended from the cradle. In a preferred form of the dispenser, the container and cradle have corresponding pins and recesses so that only a container with the correct pins or recesses can be fitted onto the dispenser for filling. This arrangement avoids the possibility of the wrong liquid being filled into a given container from a dispenser.

BRIEF DESCRIPTION OF THE PREFERRED EBODIMENTS

Various-aspects of the invention are demonstrated with-respect to the appended Figures wherein, FIG. 1 is a schematic elevational view of a dispenser according to the invention;

DETAILED DESCRIPTION OF THE PREFERRED EMBODIMENTS

Figure 1:
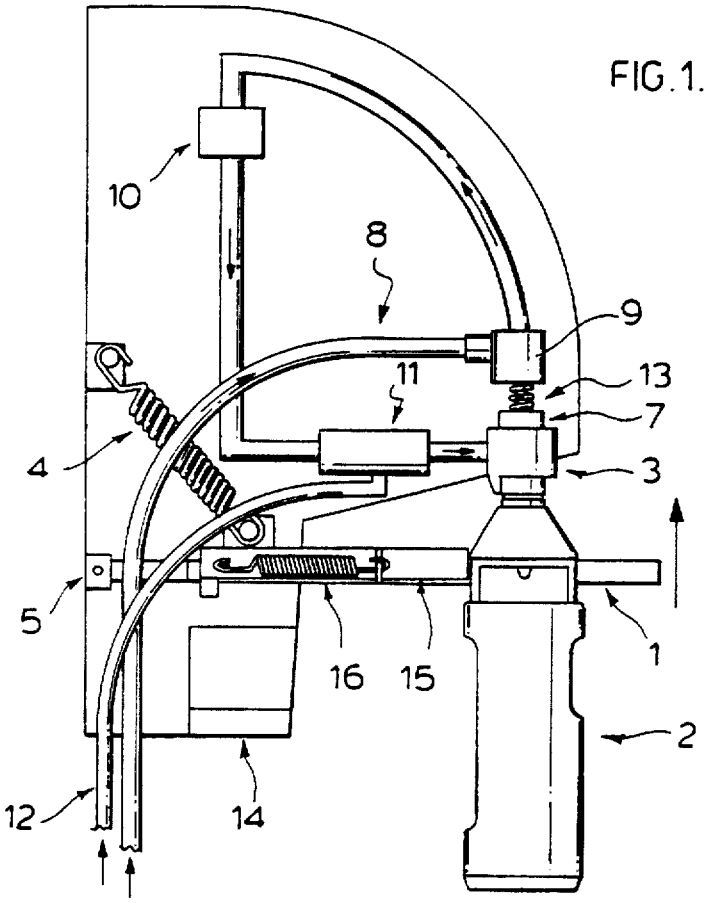

The dispenser shown in FIG. 1 comprises a support 1 for a container 2 to be filled by liquid through a dispensing head 3. The support 1 carries the weight of the container with the assistance of the action of a spring 4. The support 1 is pivoted about horizontal axis 5.

In operation, the support or cradle 1 is lowered manually, against the action of the spring 4, and the container 2 is fitted on the support 1. The force of the spring 4 urges the neck of the container into the dispensing head 3. This action, described in more detail below, moves magnet 7 upwards.

The magnet 7, which replaces the usual coil, is mounted on a solenoid valve 9 and as it moves along the valve stem it causes the valve 9 to open. Water from a source (not shown) can therefore pass along pipe 8, through valve 9, through the backflow preventer 10 and to the venturi 11 where it entrains concentrated chemical fed through pipe 12 in a conventional manner. The diluted liquid is then filled into the container 2 through the filling head 3.

With the increasing weight of the container as it fills, the cradle 1 and the container are lowered, thereby allowing the magnet 7, pushed by valve spring 13, to move back down the valve stem. This movement, at a predetermined point, closes the valve and stops the flow of water and chemical to the container. Overflowing of the container is thus automatically prevented.

The filled container is then manually released from the support 1, which is pulled back up by the spring 4 but in the absence of another container does not actuate the valve.

Also seen in FIG. 1 is a drip container 14 and a slidable drip tray 15, which is urged towards the container position by means of a spring 16.

Although in FIG. 1 the cradle 1 is shown to be pivotally mounted, but this is not essential. The cradle could alternatively be mounted for vertical movement against a spring force without a pivotal mounting.

Figure 2:
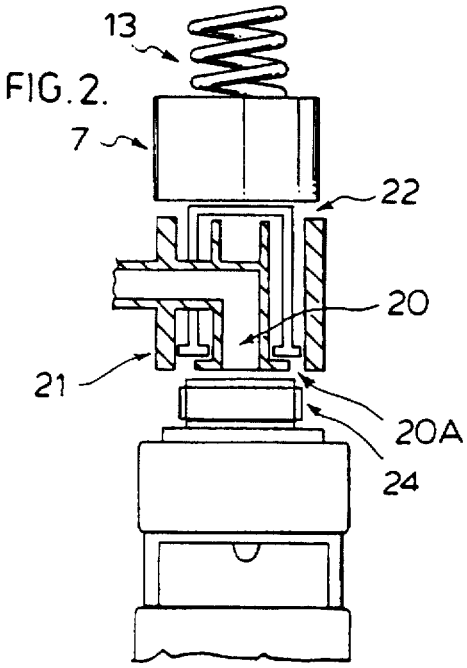
FIGS. 2 and 3 are detail views of FIG. 1 showing the operative connection between the dispenser and containers of two different sizes.
Figure 3:
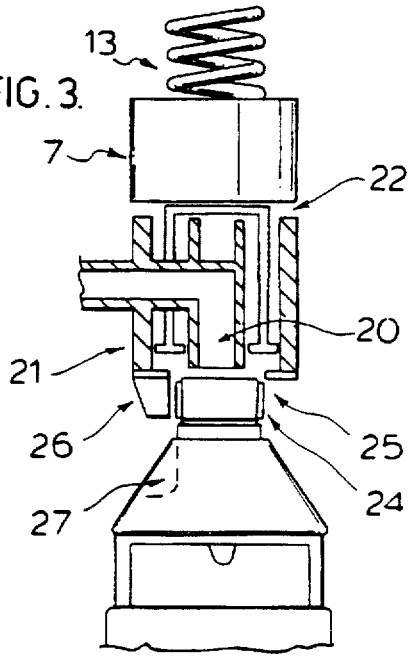

FIGS. 2 and 3 show schematically the operable connection between the container 2 and the dispensing head 3. FIG. 2 shows the connection for a relatively large diameter neck container and FIG. 3 shows the connection for a smaller diameter neck container.

The dispensing head 3 consists of two fixed concentric tubular members 20, 21, the liquid being supplied to inner tubular member 20 for filling of the container. An annular member 22 is slidably mounted between the tubular members 20, 21. When the container is mounted on cradle 1, the neck 24 of the container is forced by the spring 4 upwards and into the gap between the members 20, 21, thereby forcing the annular member 22 and thus magnet 7 upwards.

In FIG. 2, the tubular member 20 is formed with flange 20A around its bottom edge. The purpose of this is to prevent the wrong containers, in particular containers with a neck of smaller diameters being filled. It will be understood that the flange 20A will not fit inside a container neck whose inner diameter is less than that of the flange. Thus, such a container neck cannot contact the annular member 22 to move it upwards and actuate the switch.

Other means to prevent the incorrect filling of containers are described below, in relation to FIGS. 4 and 5.

In FIG. 3, the filling of the wrong containers—here containers of a larger diameter neck—is prevented by means of a ring 25 fitted on the bottom of tubular member 21. The ring 25 has a smaller inner diameter than the member 21 so that containers with an outer neck diameter above a certain size cannot contact the annular member 22.

In addition, in FIG. 3, a depending wing 26 is fitted at one point around the ring 25. This slots into a corresponding recess 27 in the shoulder of the container. Thus, containers without this special recess will not be able to contact the annular member 22, even if their neck diameter is less than the inner diameter of the ring 25.

Figure 4A:
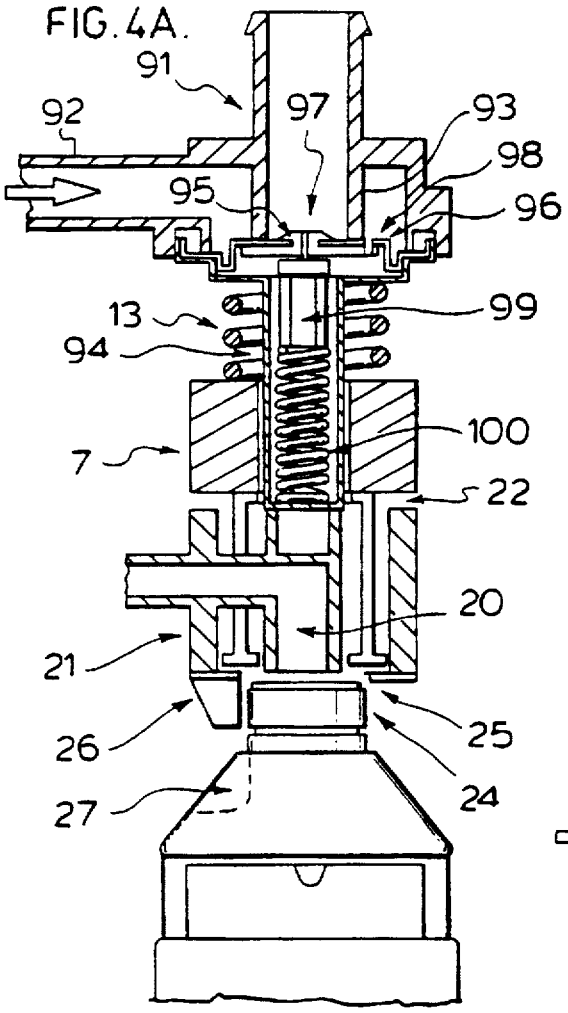
FIGS. 4A and 4B are detail views of the switch means in the off and on positions, respectively.
Figure 4B:
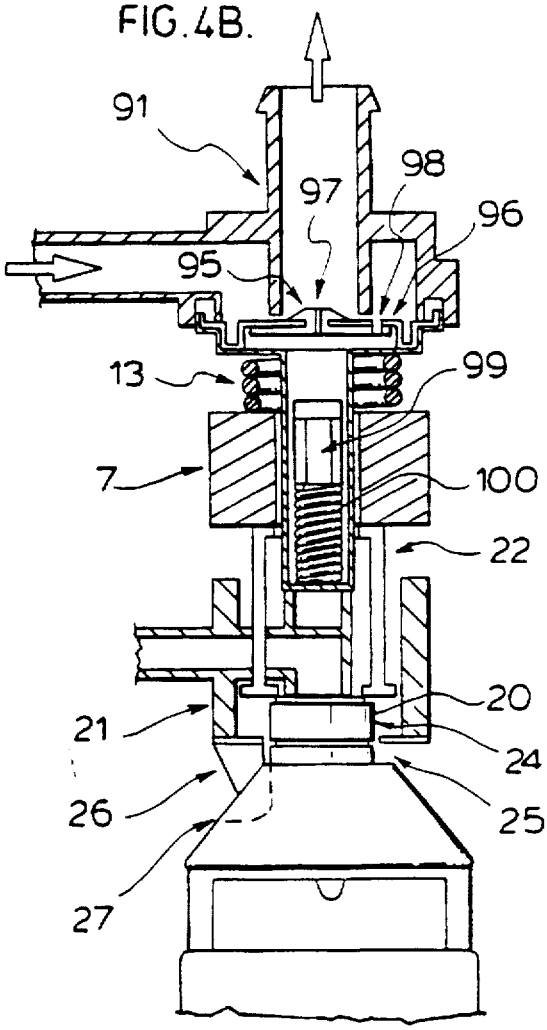

The opening and closing of the valve 9 is shown in FIGS. 4A and 4B. FIG. 4A shows the container in a position free of the filling head, ie the position it is in when it is empty and before the cradle is released or the position it is in when it is full. FIG. 4B shows the container in a position contacting the filling head, ie, the position it is in when being filled.

FIGS. 4A and 4B show the filling of the smaller neck container of FIG. 3, but it will be understood that the larger neck container of FIG. 2 is filled in the same manner.

Valve 9 comprises valve body 91 including an inlet 92 for water along pipe 8, an outlet 93 and valve stem 94. Valve spring 13 is fitted around the valve stem 94, and is contacted by the magnet 7 which in turn is contacted by the annular member 22.

The outlet 94 is closed by valve disc 95 mounted on a flexible diaphragm 96. The valve disc 95 has a central opening 97 connecting to the outlet and a lateral opening 98 which admits water from the inlet. The central opening 97 is closed by a core member 99 which is urged upwardly by a weak core spring 100.

The disc 95 is forced against the outlet 93 by the differential pressure of the water, and thus the valve 9 is shut, as seen in FIG. 4B When the container 2 moves upwardly into the filling head 3, annular member 22 pushes the magnet 7 upwards to the position seen in FIG. 4B. In this position, the magnet 7 pulls the core member 99, which is magnetically attractive, away from the valve disc 95.

This allows water through the central opening 97, thereby equalizing the pressure on either side of the disc 95 and allowing it to move away from the outlet 94. Water can thus pass through the valve, to the venturi 11 as previously described.

When the container is full, its weight in effect releases the core member 99 so that the valve is shut again.

Figure 5:
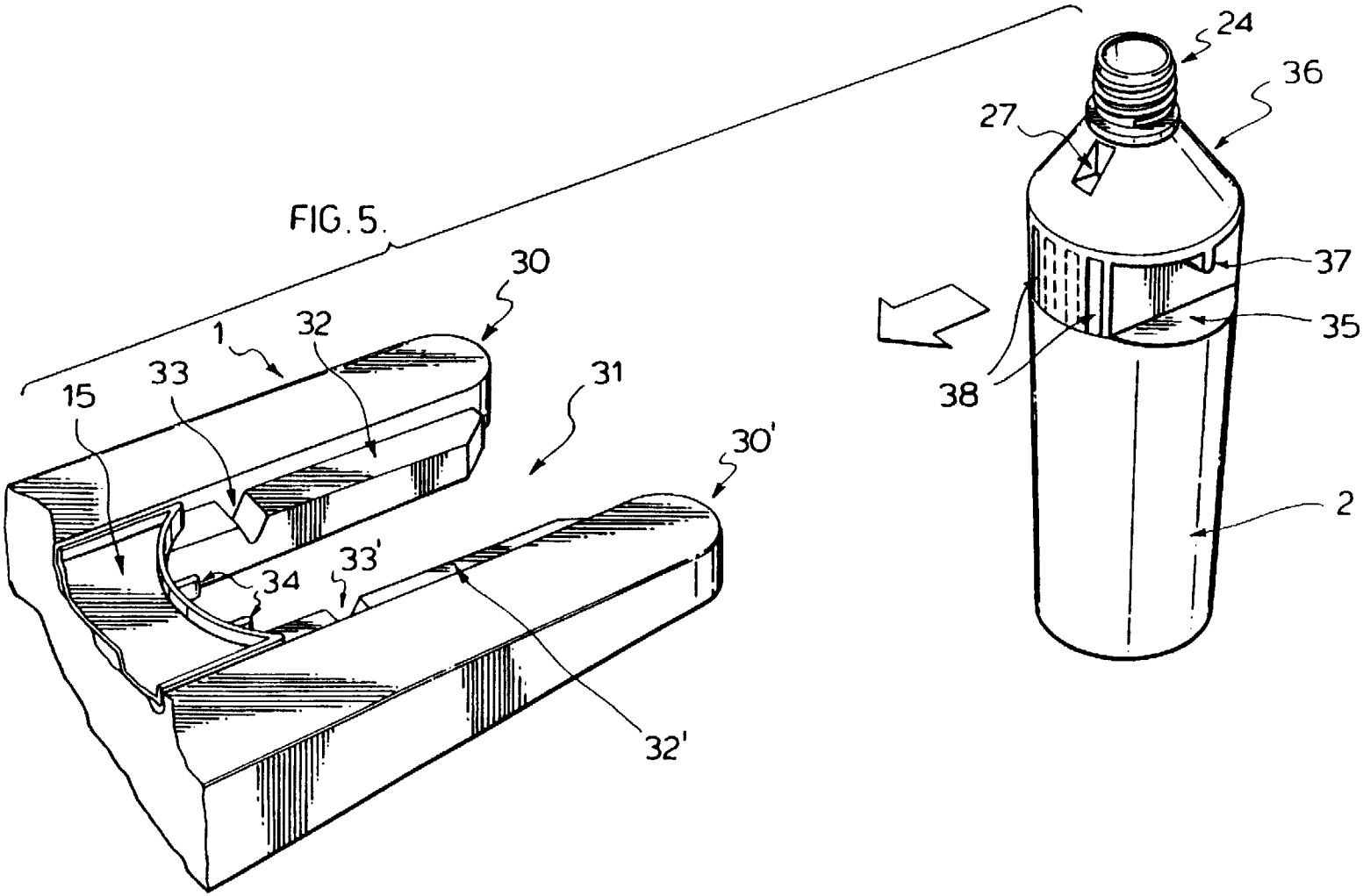
FIG. 5,is a perspective view illustrating the connection between a first container and the support in the dispenser of FIG. 1.

FIG. 5 shows the mounting of the smaller container 2 on the cradle 1. The cradle is formed with a pair of forwardly extending arms 30, 30' with a slot 31 defined therebetween. On the inside of each arm is a shoulder 32, 32' with a recess 33, 33' at one point along its length. The recesses are formed opposite each other, across the slot, and each has a generally U-shape which tapers outwardly towards the top.

Drip tray 15 is seen at the left hand side of FIG. 5. The drip tray is shown in a retracted position to which it would be pushed by a container. Without the container present in the slot 31, the drip tray 15 would normally be pulled forward by the spring 16 to a position over the recesses 33, 33', i.e. beneath filling head 3 in order to catch drips therefrom.

Underneath the drip tray 15, the slot 31 is closed and extending forwardly from the closed end of the slot is a pair of pins 34. The pins are arranged in two of five possible positions.

The container 2 has segmental recesses 35 on either side, below shoulder 36 (only one recess is seen in FIG. 5). The narrowed portion formed by recesses 35 has a width just less than the gap between the shoulders 32, 32'. A lug 37 depends from the top of each recess 35.

In the side of the container, between the recesses, slots 38 are formed, in two of five possible positions (two alternative positions are shown in dashed lines; the third one is out of view).

As previously mentioned, a recess 27 is formed in the shoulder 36 of the bottle, just below the neck 24.

In use, the cradle 1 is lowered and the container 2 is slotted into the cradle 1, along the slot 31, thereby pushing back drip tray 15. The pins 34 register in the slots 38 and the container 2 can then be allowed to hang on the cradle 1, with its lugs 37 fitting into the recesses 33, 33', on the shoulders 32, 32'.

As discussed above, the cradle is then released and the spring 4 lifts it upwards so that the neck 24 actuates the switch which controls its filling.

As the cradle pivots upwards, and then downwards again when it fills up, the shape of recesses 33, 33' allows the lugs 37 to pivot, thereby allowing the container to remain vertical.

It will be understood that unless the slots 38 of the container are in the correct position, the container cannot be pushed far enough into the cradle for it to actuate the switch. The arrangement of five pin positions and five slot positions allows ten different discrete arrangements for different dispensers filling different chemicals, using two pins.

Figure 6:
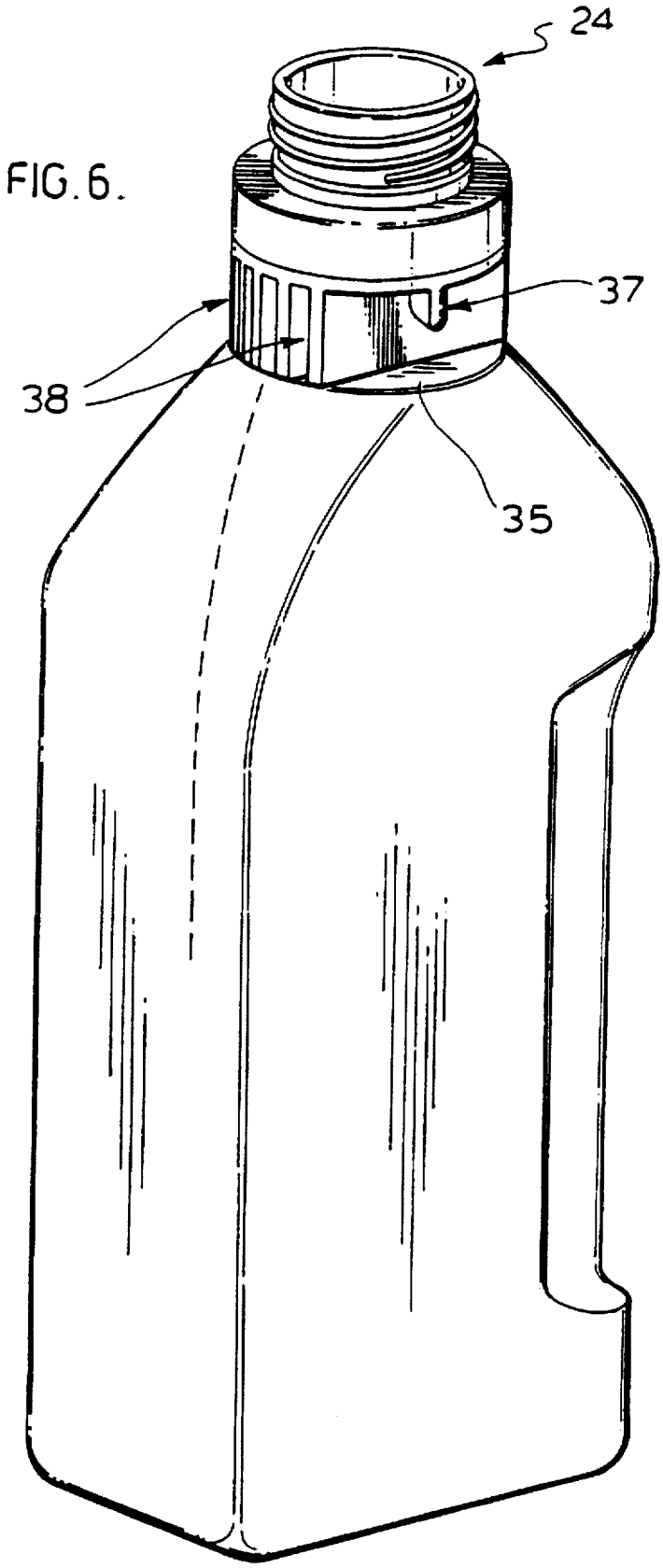
FIG. 6 is a perspective view of a second container for use with the dispenser of FIG. 1.

As seen in FIG. 6, with a large neck container the segmental recesses 35, the lugs 37 and the slots 38 are formed immediately below the neck, rather than below the shoulder. Apart from this, the fitting of the container into the cradle is as described with reference to FIG. 5.

The large neck container has, for example, a volume of 2 liters. The small neck container has, for example, a volume of 0.75 liters. For the avoidance of any doubt, it should be mentioned that the vertical distance between the lug 37 and the top of the neck 24 of the containers seen in FIGS. 5 and 6 is the same in each case. Thus, the same dispenser can be used with both containers, and indeed containers of other sizes, with the appropriate adjustment made to the filling head 3 (FIGS. 2 and 3) and to the arrangement of pins 34 (FIG. 5).

Figure 7:
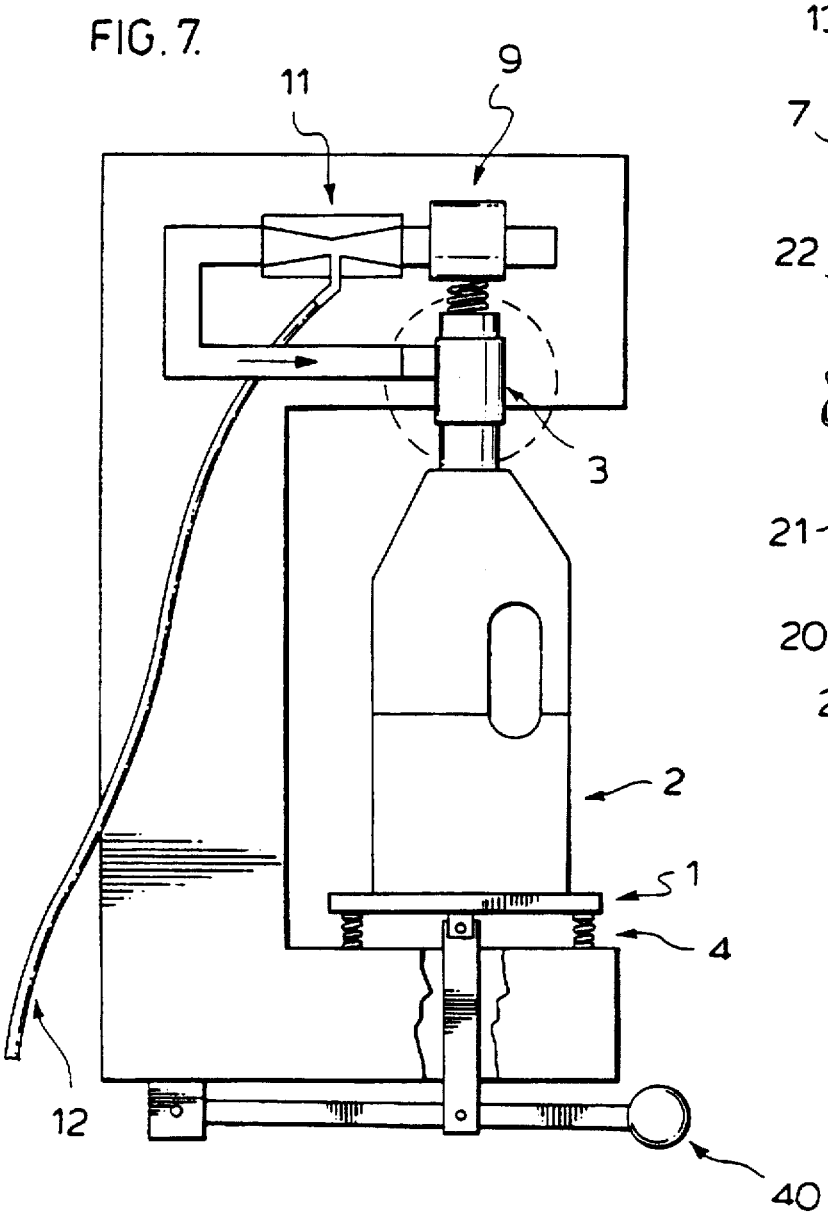
FIG. 7 is a schematic elevational view of a second embodiment of a dispenser according to the invention.
Figure 8:
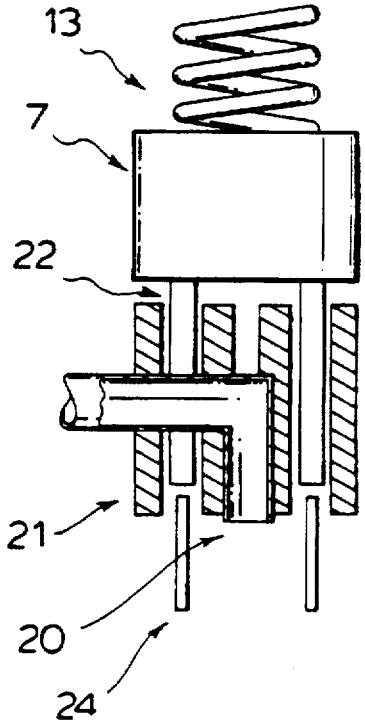
FIG. 8 is a detail view of FIG. 7 showing the operative connection between the dispenser and the container.

In the embodiment of the invention shown in FIGS. 7 and 8, the container support is arranged differently from FIG. 1 In the latter figure, the containers are suspended from a cradle, but in FIG. 7 the container is placed onto the support which is in the form of a platform. In other respects, the dispenser of FIG. 7 is similar and so the same numerals are used to denote corresponding parts.

In FIG. 7, the platform 1 can be manually lowered by means of a pivoting handle 40 to allow a container 2 to be placed thereon. Release of the handle 40 allows the springs 4 to urge the bottle neck upwards into the dispensing head 3. As shown in FIG. 8, movement of the bottle neck into the dispensing head causes annular member 22 to move upwards, thereby moving magnet 7 on the valve 9. As the weight of the container increases, the container moves out of the dispensing head 3 and the valve is turned off.

Needless to say, other types of switches can be used to control the flow of liquid through the filling head than the type described above. For example, a conventional solenoid valve could be used, together with a microswitch operated by movement of the annular member. Alternatively, optical switches or proximity detectors could be used to detect the position of the container and turn on or off the valve. The important feature of the switch means is that it is operated by the upward movement of the empty container and the opposite movement of the filled container.

The coil spring 4 described in relation to the illustrated embodiments could of course be replaced by other resilient members, for example, leaf springs or elastomeric springs (rubber bands), or even pneumatic springs. Furthermore, the force urging the cradle upwards could be obtained by means of a weight attached to a cord running over a pulley above the cradle, and connected to the cradle, or by means of a weight on a counter-balance arm on the opposite side to the pivot from the cradle. All means of urging the support for the container upwards, allowing the support to fall as the container fills, and again lifting the support with another empty container, are covered by the invention as defined in the attached claims.

Although preferred embodiments of the invention are described herein in detail, it will be understood by those skilled in the art that variations may be made thereto without departing from the spirit of the invention or the scope of the appended claims.

We claim:

1. A dispenser for filling a container with a liquid, comprising: a support for the container to be filled; a source of liquid; switch means controlling the flow of liquid into the container; and resilient means urging the said support in an upwards direction toward the source of liquid; wherein the switch means is mechanically operated by the container on the support, whereby the switch means is mechanically activated by an empty container being urged upwards by the resilient means and mechanically deactivated when the weight of the filled container overcomes the force of the resilient means.

2. A container for use in a liquid dispenser having a cradle which engages said container in an upper region of the container and actuates liquid dispensing by moving a neck portion of said container up into a dispenser head where such cradle includes a device for aligning said container neck portion with such dispenser head, said container comprising:

i) a body portion having a bottom, a sidewall and upper region terminating in said neck portion;

ii) an upper portion comprising means for engaging a dispenser cradle and support said container on such cradle;

iii) said sidewall of the container having a register means for fixedly interengaging a complementary register means on a dispenser cradle and thus precluding rotational movement of said container;

iv) said register means when it interengages a complementary register means mechanical permits alignment of said container neck with a dispenser head to permit dispensing and said register means when it fails to mechanical interengage avoids such alignment to preclude dispensing.

3. A container of claim 2 wherein said register means is molded in said container sidewall.

4. A container of claim 2 wherein said register means comprises a plurality of adjacent pins or recesses.

5. A container of claim 4 wherein said recesses are provided circumferentially across said sidewall.

6. A container of claim 4 wherein said recesses are of a shape and arrangement unique to a particular liquid to be dispensed in said container.

7. A container of claim 6 wherein said recesses are aligned and molded in said container sidewall.

* * * * *